US007867421B2

(12) United States Patent
Poulin et al.

(10) Patent No.: US 7,867,421 B2
(45) Date of Patent: Jan. 11, 2011

(54) METHOD FOR THE PRODUCTION OF FIBRES WITH A HIGH CONTENT OF COLLOIDAL PARTICLES AND COMPOSITE FIBRES OBTAINED THUS

(75) Inventors: Philippe Poulin, Talence (FR); Stephane Badaire, Talence (FR); Cecile Zakri, Le Barp (FR); Maryse-Marie-Therese Maugey, Gradignan (FR)

(73) Assignees: Centre National de la Recherche Scientifique (C.N.R.S.), Paris Cedex (FR); Universite des Sciences Et Technologies (Bordeaux 1), Talence Cedex (FR)

( * ) Notice: Subject to any disclaimer, the term of this patent is extended or adjusted under 35 U.S.C. 154(b) by 1380 days.

(21) Appl. No.: 10/554,911

(22) PCT Filed: Apr. 28, 2004

(86) PCT No.: PCT/FR2004/001034

§ 371 (c)(1),
(2), (4) Date: Feb. 2, 2006

(87) PCT Pub. No.: WO2004/099475

PCT Pub. Date: Nov. 18, 2004

(65) Prior Publication Data

US 2006/0121275 A1 Jun. 8, 2006

(30) Foreign Application Priority Data

Apr. 30, 2003 (FR) ..... 03 05379

(51) Int. Cl.
*D01D 5/30* (2006.01)
*B29C 47/88* (2006.01)

(52) U.S. Cl. ..... 264/172.11; 264/103; 264/183; 264/185; 264/211.12; 264/211.16; 264/233

(58) Field of Classification Search ..... None
See application file for complete search history.

(56) References Cited

U.S. PATENT DOCUMENTS 4,315,877 A * 2/1982 Coplan et al. ..... 264/45.9

(Continued)

FOREIGN PATENT DOCUMENTS

FR 2 805 179 A 8/2001

(Continued)

OTHER PUBLICATIONS

Sun et al, "Impact of Modified Surface Properties on Photocatlytic Activities of $TiO_2$ for Degradation of High Polymers", Journal of Zhejiang University (Agric. & Life Sci.), 2001, 27(2) 195-199.

(Continued)

*Primary Examiner*—Jill Gray
(74) *Attorney, Agent, or Firm*—Nixon & Vanderhye P.C.

(57) ABSTRACT

The invention relates to a method for the production of composite fibers with an increased content of colloidal particles, made from a pre-fiber, comprising a polymeric binder and colloidal particles, during which the chemical structure of the polymeric binder is degraded at a temperature of the order of ambient temperature such as to at least partially eliminate the above. The invention further relates to a fiber comprising a polymeric binder and colloidal particles, combining an excellent mechanical strength and a content of colloidal particles greater than 70% by mass.

14 Claims, 1 Drawing Sheet

U.S. PATENT DOCUMENTS

| | | | | |
|---|---|---|---|---|
| 4,550,123 | A * | 10/1985 | Lopatin et al. | 521/64 |
| 5,626,650 | A * | 5/1997 | Rodriguez et al. | 95/116 |
| 7,285,591 | B2 * | 10/2007 | Winey et al. | 524/495 |
| 7,288,317 | B2 * | 10/2007 | Poulin et al. | 428/370 |
| 2003/0102585 | A1 * | 6/2003 | Poulin et al. | 264/11 |
| 2008/0118753 | A1 * | 5/2008 | Poulin et al. | 428/372 |
| 2008/0124507 | A1 * | 5/2008 | Poulin et al. | 428/36.9 |

FOREIGN PATENT DOCUMENTS

| | | |
|---|---|---|
| FR | 2 828 500 | 2/2003 |
| GB | 1 174 959 A | 12/1969 |

OTHER PUBLICATIONS

International Search Report of PCT/FR2004/001034, mailed Dec. 9, 2004.

Poulin et al., "Films and fibers of oriented single wall nanotubes", vol. 40, No. 10, Aug. 2002, XP004371674.

* cited by examiner

METHOD FOR THE PRODUCTION OF FIBRES WITH A HIGH CONTENT OF COLLOIDAL PARTICLES AND COMPOSITE FIBRES OBTAINED THUS

This application is the US national phase of international application PCT/FR2004/001034, filed 28 Apr. 2004, which designated the U.S. and claims priority of FR 03/05379, filed 30 Apr. 2003, the entire contents of each of which are hereby incorporated by reference.

The present invention relates to a process for obtaining composite fibers with a high colloidal particle content from a prefiber comprising a polymeric binder and colloidal particles, to the fibers thus obtained and to the applications of these fibers.

Within the context of the invention, the term "prefiber" is understood to mean any composite fiber comprising a polymeric binder and colloidal particles, which has not yet undergone the process according to the invention. This definition covers, in particular, the prefibers still in the line for producing composite fibers with a high content of colloidal particles and the fibers that are completed and ready to be used, on which it is desired to carry out the process according to the invention.

The use of the term "prefiber" hereafter will therefore have this meaning.

In contrast, the term "fiber" will be reserved for the finished product that has undergone a treatment for increasing the content of colloidal particles or for finished fibers serving as reference and/or as point of comparison.

The UIPAC standard defines in the general sense colloidal particles as being particles whose size is between 1 nanometer and a few microns. The present invention when the term "colloidal particles" is used refers to this definition.

To give an example, nanotubes, and more particularly carbon nanotubes, represent a reference as regards colloidal particles and their application in the production of composite fibers.

In particular, carbon nanotubes possess remarkable physical properties (thermal conductivity, electrical conductivity, mechanical properties, high specific surface area, ability to deform under charge injection, etc.). These properties mean that carbon nanotubes can be made from materials that can be used for many applications: composites, electron emission, sensors, electromechanical actuators, conductive fabrics, electrodes, hydrogen storage, batteries.

In order to be more easily exploited, nanotubes may be spun, as for example in patent FR 2 805 179, or may be included as a filler in a composite fiber.

The fibers obtained usually consist of organic polymers and carbon nanotubes. This particular composition may give the fiber useful properties (processability, flexibility, low cost, etc.), but it is not optimal in many situations.

This is because it will often be desirable to be able to have fibers with a very high content of carbon nanotubes and a low amount of polymer, or else, where the case may be, no polymer at all. This would make it possible to obtain better electrical or thermal transport properties and to make the surface of the nanotubes more easily accessible for electrochemical and adsorption applications of nanotubes (sensors, energy storage, actuators).

The spinning process described in patent FR 2 805 179 consists in assembling nanotubes in the flow of a coagulating solution. This is carried out by injecting, through a spinneret, a dispersion of nanotubes into the flow of the coagulating solution. In the case of aqueous systems, the nanotube dispersion is generally obtained by using amphiphilic species, such as sodium dodecyl sulfate (SDS). During injection, a prefiber is formed. This prefiber can then be dried and densified in order to end up with a final fiber. The coagulating solutions normally used are polymer solutions, especially a polyvinyl alcohol (PVA) solution. They are easy to use and ensure good process reliability.

However, the final fiber contains a high proportion of polymer, which may cause the abovementioned problems.

According to the principle of patent FR 2 805 179, another method for obtaining fibers with a very high nanotube content may be envisaged. Instead of using a polymer solution as coagulating solution, the above patent employs an acid solution, especially a solution comprising 37 wt % hydrochloric acid in water. The rest of the process remains unchanged.

In general, it is also possible to use a poor solvent for the initially dispersed nanotubes, this poor solvent being partially miscible with the solvent for dispersing the nanotubes. The term "poor solvent" is understood to mean a solvent which, by its nature or by the agents that it contains, causes the nanotubes to coagulate.

The acid here has the role of hydrolyzing the surfactants used to disperse the nanotubes, and to do so immediately the dispersion (nanotubes/SDS/water) comes into contact with this acid. Owing to the rapidity of the hydrolysis process, the nanotubes, which are no longer stabilized by an amphiphilic agent, reaggregate under the action of the van der Waal's forces, while maintaining the alignment that is conferred on them by the rate of injection of the dispersion.

It is thus possible with this process to obtain fibers consisting 100% of aligned nanotubes. These fibers can be handled and conductivity measurements have shown a very low resistivity of around $5\times10^{-3}$ ohms.cm, which represents a reduction by a factor of 200 over an untreated fiber made according to the main teaching of patent FR 2 805 179 with PVA as coagulating agent.

This variant therefore makes the fibers particularly useful for applications as actuators or conductive fabrics, for which applications a high conductivity is necessary.

Direct spinning, that is to say with no coagulating polymers, does however pose a difficulty. This is because, even though it proves to be effective to give fibers with a very high nanotube content, it is less reliable than the process with a polymer, and the fibers obtained remain very difficult to handle.

Treatment methods have been proposed that rely essentially on the use of a spinning process based on the process with a polymer described above, followed by partial or complete elimination of the polymer, especially in the context of the application of fibers where the presence of such a polymer would be problematic. Even though this approach requires an additional step in the preparation, it does appreciably increase the reliability and robustness of the process.

The simplest means, that described most often and best known for avoiding the presence of organic polymer on the fiber, consists in heating it to a high temperature in order to burn off or pyrolyze the polymer. The prefiber must therefore already contain a substantial fraction of nanotubes in order to withstand this treatment. A minimum nanotube content of around 15 to 30% is then necessary at the start. In addition, such a treatment may result in degradation of the intrinsic properties of the nanotubes and disorganization of the actual fiber.

Prefibers, for example those resulting from the process described in patent FR 2 805 179, can withstand this treatment.

However, the thermal process described above is a process that is violent and particularly difficult to control if it is desired to maintain the integrity of the fiber and/or of the nanotubes. In particular, the fibers thus obtained have a tendency to become brittle after such annealing.

The difficulties encountered when treating the prefibers comprising carbon nanotubes are, of course, the same when the prefibers comprise colloidal particles other than carbon nanotubes and, for example, SiC whiskers or carbon nanofilaments or boron nitride nanotubes.

The inventors have therefore developed a process for obtaining composite fibers comprising a polymeric binder and colloidal particles, with a high colloidal particle content, allowing gentle and controlled elimination of the polymeric binder and easy and practical implementation that can be adapted to any composite prefiber comprising a polymeric binder and colloidal particles, irrespective of the method of synthesizing and preparing these prefibers.

Figure 1:
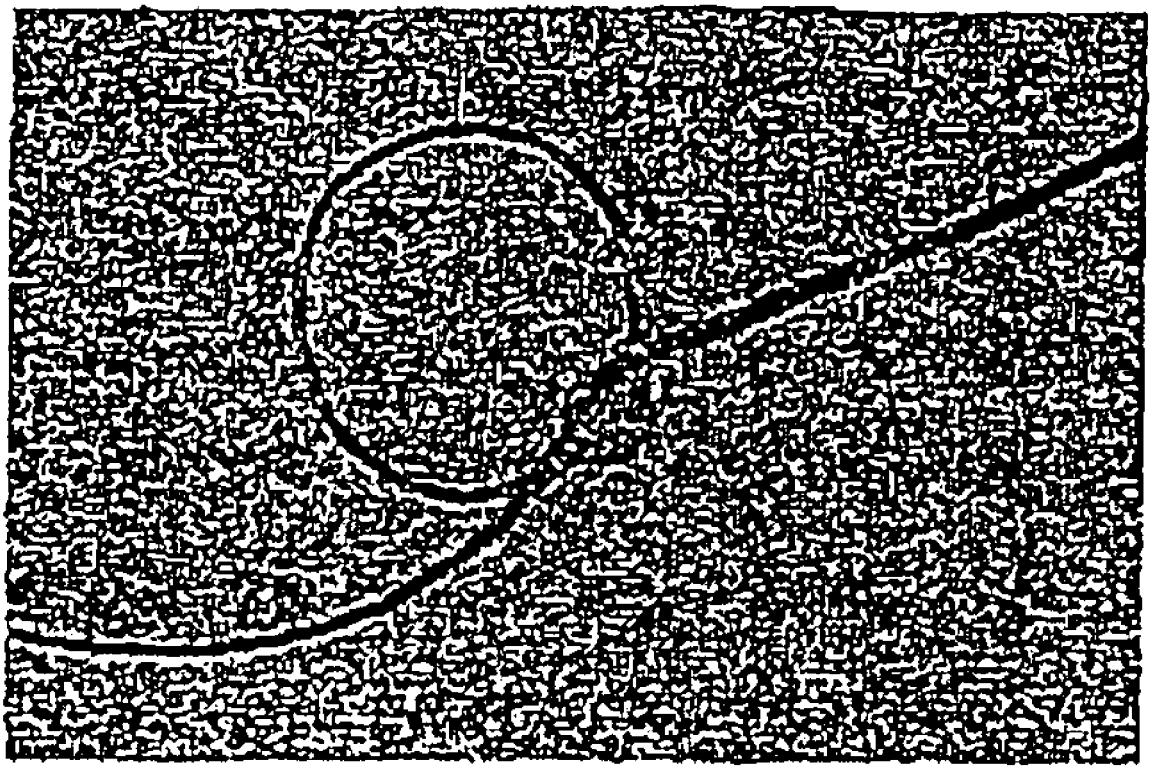
FIG. 1 shows fibers obtained by the process described herein.

For this purpose, the process for obtaining composite fibers with a high colloidal particle content from a prefiber comprising a polymeric binder and colloidal particles is, according to the invention, characterized in that, at temperatures close to ambient temperature, the chemical structure of said polymeric binder is degraded so as to at least partly remove it.

Ideally, this process may be carried out for any type of prefiber comprising a polymeric binder and colloidal particles, and it will be particularly suitable in the case in which the colloidal particle content in the prefiber is less than 30% by weight, something which becomes particularly tricky in the case of the known processes.

The fact of using a gentle prefiber treatment means that it is possible to use prefibers whose colloidal particle content is much lower than the content normally needed to be able to carry out a treatment to remove the polymeric binder without the risk of destroying or damaging the cohesion of the prefibers.

More particularly, the process according to the invention may be used for what is called a composite prefiber, containing initially at least 10% by weight of colloidal particles.

This is because, for colloidal particle contents of less than 10%, the process will have the same difficulties as those encountered when using the standard processes for removing the polymeric binder, with the risk of disrupting the cohesion of the treated prefiber.

Advantageously, the process according to the invention includes a step of immersion in or exposure to an agent that degrades the polymeric binder over a time and for an agent concentration that are determined by the desired amount of polymer remaining.

Thus, the removal of the polymer is much better controlled. The properties of the fiber may be optimized by obtaining, for example, fibers that combine both good electrical transport properties with good mechanical properties.

More particularly, the process according to the invention involves degrading said polymeric binder by chemical degradation.

In this regard, the process according to the invention involves chemical degradation obtained using an agent chosen from acids, oxidizing agents and/or enzymes.

According to an alternative method of implementing the process according to the invention, said polymeric binder is degraded photochemically.

In particular, the process according to the invention may be carried out in a procedure such that the degradation step is followed by a step in which said fiber is washed, drawn and/or twisted.

In this case, the procedure as described above may be considered as representing the final step of an overall procedure for manufacturing composite fibers.

In another alternative method of implementing the process according to the invention, the procedure may represent, within the context of the invention, only a post-treatment of composite prefibers.

In yet another alternative method of implementing the process according to the invention, said fiber of high colloidal particle content is then impregnated with a new polymer.

This process also makes it possible to exchange the polymer that is combined with the colloidal particles. This is because, after controlled chemical or photochemical removal, it is possible to immerse the fiber in a new polymer. Removal of the first polymer makes it possible in the end to have a higher quantity of added polymer after manufacture.

This alternative method may prove to be particularly beneficial when it is desired to combine both the properties of a fiber having a high colloidal particle content with the special properties of a polymer that it is impossible to use directly in the composite fiber manufacturing line and especially within the context of the use of a spinning process.

Preferably, the new polymer is chosen from crosslinkable, functionalizable, thermosetting, pyrolyzable and/or conductive polymers.

As pyrolyzable polymers, mention may in particular be made of polyacrylonitrile (PAN), cellulose, and polyphenolic resins which, for example, may subsequently be converted into carbon by a heat treatment, as in the manufacture of conventional carbon fibers. Thus it will be possible to obtain carbon composite fibers/carbon nanotubes of potentially very high performance from a mechanical standpoint.

Preferably, the process according to the invention is implemented for a polymeric binder consisting of PVA.

Even more preferably, the process according to the invention is particularly suitable for colloidal particles that are nanotubes.

Finally, and again more particularly, the process according to the invention is particularly suitable for carbon nanotubes.

The present invention also relates to composite fibers with a high colloidal particle content that result from this process and in particular to the composite fibers comprising a polymeric binder and colloidal particles, characterized in that they combine both a mechanical strength with a colloidal particle content of greater than 70% by weight.

The fibers according to the invention therefore combine mechanical strength and carbon nanotube content. In fact, these fibers can be easily bent without them breaking, allowing them to be used more easily in processing operations, such as weaving, braiding, inclusion in a composite, etc.

More particularly, the composite fibers according to the invention comprise nanotubes as colloidal particles.

Even more particularly, said nanotubes are carbon nanotubes.

Finally, the present invention relates to the applications of the composite fibers defined above to electrical transport, heat transfer, and energy storage and conversion.

More particularly, the fibers according to the invention will be used to produce sensors, actuators and/or conductive fabrics.

A prefiber is produced in accordance with the teaching of patent FR 2 805 179. This process consists in assembling the nanotubes in the flow of a coagulating solution, which may be a polymer solution such as an aqueous polyvinyl alcohol (PVA) solution. Formed on leaving the spinneret is a prefiber of low density, consisting of entangled nanotubes and PVA. This prefiber is extracted from the water and dried. Before being extracted from the water, it may be passed through baths of pure water so as to be washed by partial desorption of the PVA. Next, during the drying operation, the prefiber shrinks to form a finer, denser and mechanically stronger fiber. The structure of this fiber may be improved by methods involving stretching or twisting. The fiber obtained contains a not insignificant fraction of polymer, even after washing in pure water. For a fiber made with polyvinyl alcohol (PVA), the polymer fraction is about 50%, even after being washed several times with pure water. The room-temperature electrical resistivity of a prefiber consisting of single-walled nanotubes, synthesized by the electric arc method but not purified, is about 1 ohms.cm for a fiber made from a prefiber that has been washed with pure water. After being washed six times with pure water, the resistivity drops to 0.3 ohms.cm. Further washing does not reduce the resistivity significantly.

To remove the coagulating polymer in a more controlled manner, and therefore to make the final fiber less brittle, the prefiber is immersed in a solution containing a chemical agent that will degrade the polymer and/or contribute to its desorption from the nanotubes. For example, strong oxidizing agent or acid solutions are used. The prefiber is immersed therein so as to degrade the polymer and promote its desorption, without affecting the nanotubes. The immersion time in the acid allows the polymer to be controllably degraded and desorbed to a greater or lesser extent. Next, the prefiber, partly or completely stripped of the polymer, may be washed and dried, as in the case of a prefiber containing a high proportion of polymer. This fiber may undergo post-treatment operations and be drawn or twisted in order to improve the densification or alignment of the nanotubes along the axis of the fiber.

These treatments are also used to exchange this polymer. It is generally difficult for a fiber containing a high PVA fraction to be impregnated directly with a new polymer. After partial or complete removal of the PVA, in an acid and/or an oxidizing agent, the prefiber may be immersed in a liquid polymer or polymer solution so as to coat the nanotubes with the new polymer. The prefiber is then extracted from this bath and dried to form a finer and denser fiber containing the nanotubes and the new polymer. This procedure therefore makes it possible to obtain a composite fiber having a very high nanotube content with any type of polymer, even with those which initially could not be used during spinning. In conventional composite fibers, it is possible to introduce the nanotubes directly into a polymer that will be spun. However, this direct spinning does not allow a large quantity of nanotubes to be introduced into the fiber. As soon as the nanotube content exceeds 10% by weight, it becomes very difficult to make uniform dispersions suitable for spinning, whereas the present invention makes it possible to greatly exceed 10%, and to obtain composite fibers with a nanotube content of between 30 and 100% by weight.

The examples described below were produced on composite prefibers of carbon nanotubes obtained by spinning using the process described in patent FR 2 805 179.

Characteristics of the Spinning:

Prefiber obtained by injecting a nanotube solution into the flow of a PVA solution. The prefiber is then dried.

Nanotubes: synthesized by electric arc.

Nanotube solution: suspensions containing 0.6% by weight of nanotubes and 1.2% of SDS (dispersant). The solution is ultrasonically homogenized.

Coagulant polymer solution: aqueous solution containing 3% PVA by weight (100 000 g/mol and 88% degree of hydrolysis).

Nanotube solution injection rate: 50 ml/h through a 0.5 mm diameter cylindrical orifice.

Flow speed of the PVA solution: 10 m/min.

The prefiber formed under these conditions is then immersed in various baths and extracted, in order to be dried and densified. The electrical resistivity p is measured in order to check the reduction in polymer content. This is lower the higher the nanotube content, since PVA is an insulating polymer and the carbon nanotubes are conducting.

The thermal annealing at 1000° C. in an inert atmosphere is carried out in order to obtain control fibers.

The results are given in the table below.

| Ref. | Treatment | ρ (ohms · cm) |
|---|---|---|
| a | 1 $H_2O$ bath for 1 hour + drying | 0.8 |
| b | 6 $H_2o$ baths for 1 hour + drying | 0.27 |
| c | 10 $H_2O$ baths for 1 hour + drying | 0.25 |
| d (control) | Fiber b + thermal annealing | 0.01 |
| e | 1 18% HCl bath for 5 min. + 1 $H_2O$ bath for 1 hour + 1 18% HCl bath for 5 min. + 1 $H_2O$ bath for 1 hour + drying | 0.11 |
| f | 1 37% HCl bath for 5 min. + 1 $H_2O$ bath for 1 hour + 1 37% HCl bath for 5 min. + 1 $H_2O$ bath for 1 hour + drying | 0.025 |
| g | 1 5% $KMnO_4$ bath for 10 min. + 1 $H_2O$ bath for 1 hour + drying | 0.07 |
| h | Fiber b + 1 37% HCl bath for 5 min. + 1 $H_2O$ bath for 1 hour + drying | 0.08 |

The following improvements in the electrical conductivity may therefore be observed:

fiber e is more conductive than fiber c by a factor of greater than 2;

fiber f is more conductive than fiber e by a factor of greater than 4 (by increasing the acid concentration);

fiber g is more conductive than fiber c by a factor of greater than 3; and fiber h is more conductive than fiber b by a factor of greater than 3.

For comparison, a fiber prepared using the same spinning method was used, but with a coagulating polymer that does not degrade in the presence of hydrochloric acid, such as a water-soluble cationic polyacrylamide derivative.

This polymer can be used, as described in patent FR 2 805 179, in the same way as PVA. It induces flocculation of the nanotubes under flow and therefore lends itself to spinning.

A prefiber formed with this polymer was immersed in an aqueous hydrochloric acid solution, then washed and dried under the same conditions as those used for PVA. However, unlike the case of PVA, there is no significant improvement in the electrical conductivity, which proves that the increase in conductivity in the case of PVA does not derive from a modification of the nanotubes (doping for example), but actually from the degradation and desorption of the polymer in the presence of hydrochloric acid.

Other Types of Degradation:

UV Irradiation

This experiment was carried out on dried fiber irradiated with UV radiation, which also allowed the polymer to be removed in a more controlled fashion than by thermal annealing.

| Ref. | Treatment | ρ (ohms · cm) |
|---|---|---|
| i | fiber a $H_2O$ + UV irradiation for 15 min. | 0.30 |

Certain enzymes present in the natural medium have the capability of degrading polymers such as PVA. These enzymes are in general used to cleanse the spent sludge from textile factories, which are large consumers of polymers, which act by modifying the polymer and catalyzing the reaction of hydrolyzing one of the functional groups of the modified polymer. An enzyme such as *Alcaligenes Faecalis* KK314 allows this type of degradation with PVA. It is possible to envisage the use of other enzymes for PVA or for other polymers.

The above electrical conductivity data show that the removal of the polymer, by promoting its degradation and/or its desorption by baths in acid or oxidizable solutions or by UV treatment, is real and gives good results. Furthermore, the longer the baths and the higher the concentration of oxidizing or acid species of the solution, the more the removal.

However, the photograph in FIG. 1 shows that the fibers obtained maintain good resistance to perpendicular forces. This is because the fibers can be easily bent, without breaking, unlike the case of thermally annealed fibers.

It is possible to remove the polymer before compaction and drying of the prefiber, or else afterwards (examples h and i). In both cases, an appreciable reduction in the electrical resistivity is obtained.

However, removal before drying and compacting offers the opportunity of introducing a new polymer and resulting in a composite fiber having a very high nanotube content with a polymer which could not be introduced initially. Two examples with a thermosetting epoxy resin and a silica mineral polymer will be given by way of illustration.

Composite fibers of nanotubes in organic resins have already been produced directly (introduction of nanotubes into the resin followed by spinning of the filled resin). This method cannot be used to introduce a high proportion of nanotubes, as it is impossible to spin a polymer that is excessively filled.

According to the invention, the prefiber (from which the organic species present are partially or completely removed by physico-chemical means) is immersed in a solution containing the resin. The resin thus impregnates the prefiber.

By controlling the resin concentration in the solution (from 0 to 100%), it is possible to control the amount of resin absorbed. The impregnated prefiber condenses on drying, resulting in a fiber containing a high proportion of nanotubes. The resin used has a Young's modulus of 4 GPa and is insulating. It is diluted to 10 wt % in a DMSO (dimethylsulfoxide) solution. In parallel, the prefiber is introduced into a DMSO bath and then immersed in the resin solution for 10 minutes. The prefiber is extracted from the solution and heated for 2 hours at 180° C. so as to cure the resin. The final fiber, consisting of a high fraction of nanotubes, is conductive and its Young's modulus is 12 GPa.

In the second example, the prefiber is introduced into a hydroalcoholic tetraethoxysilane (TEOS) solution. After hydrolysis, the TEOS polycondenses to form a three-dimensional silica ($SiO_2$) network. This network forms upon drying the fiber, and it results in a silica/nanotube composite fiber containing a high proportion of nanotubes. It is possible to make the silica mesoporous by introducing surfactants (for example, trimethylcetylammonium bromide), while maintaining conduction properties. This combination of properties is particularly useful for electrochemical applications (batteries, actuators, sensors). It is also possible to induce covalent bonds between the nanotubes and the mineral network by using nanotubes that are prefunctionalized by chemical functional groups capable of being grafted onto the silica oligomers.

This very simple process makes it possible in fact to impregnate the nanotubes with any polymer, whether mineral or organic, provided that the nanotubes do not have to be dispersed in the polymer in order to spin the prefiber. The nanotubes are assembled beforehand, the polymer then being incorporated, no specific properties as regards its nature being required. This method allows many options, by varying the types of polymers, their concentration and the treatment times; crosslinkable monomers, oligomers or polymers possessing chemical functions capable of being grafted onto functionalized nanotubes are used; it is possible to covalently bond the nanotubes to the polymeric network.

The process according to the invention may be applied to any other composite fiber produced using other processes. However, it is necessary for the nanotube content, before removal of the polymer, to be sufficient for the fiber to maintain a certain cohesion after removal of the polymer. Typically, it is necessary for the nanotubes to form at least a percolated network.

The invention claimed is:

1. A process for obtaining composite fibers with a high colloidal particle content from a prefiber comprising a polymeric binder and colloidal particles, said process comprising degrading the chemical structure of said polymeric binder at a temperature close to ambient temperature so as to at least partly remove said polymeric binder from said colloidal particles to produce a fiber, the step of degrading being effected by chemical degradation or photochemically, said chemical degradation being produced by at least one of an acid, an oxidizing agent and an enzyme.

2. The process as claimed in claim 1, wherein the colloidal particle content in the prefiber is less than 30% by weight.

3. The process as claimed in claim 1, wherein the composite prefiber initially contains at least 10% by weight of colloidal particles.

4. The process as claimed in claim 1, further comprising immersing said prefiber in or exposing said prefiber to an agent that degrades the polymeric binder.

5. The process as claimed in claim 1, wherein said degrading is followed by a step in which said fiber is at least one of washed, drawn and twisted.

6. The process as claimed in claim 1, wherein said process is the final step of an overall procedure for manufacturing composite fibers.

7. The process as claimed in claim 1, wherein said process is a post-treatment of composite fibers.

8. The process as claimed in claim 1, wherein the fiber is further impregnated with a polymer.

9. The process as claimed in claim 8, wherein the polymer is chosen from crosslinkable, functionalizable, thermosetting, pyrolyzable and/or conductive polymers.

10. The process as claimed in claim 1, wherein the polymeric binder consists of PVA.

11. The process as claimed in claim 1, wherein the colloidal particles are nanotubes.

12. The process as claimed in claim 11, wherein the nanotubes are carbon nanotubes.

13. A process for obtaining composite fibers with a high colloidal particle content from a prefiber comprising a polymeric binder and colloidal particles, said process comprising degrading the chemical structure of said polymeric binder at a temperature close to ambient temperature so as to at least partly remove said polymeric binder from said colloidal particles to produce a fiber, and further impregnating the fiber with a polymer.

14. The process of claim 13, wherein the polymer is chosen from crosslinkable, functionalized, thermosetting, pyrolyzable and/or conductive polymers.

* * * * *